US012312052B1

(12) United States Patent
Farrell

(10) Patent No.: US 12,312,052 B1
(45) Date of Patent: May 27, 2025

(54) SYSTEMS AND METHODS FOR CONTROLLING MARINE VESSELS BASED ON SEAT OCCUPANCY

(71) Applicant: Brunswick Corporation, Mettawa, IL (US)

(72) Inventor: Kevin T. Farrell, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 204 days.

(21) Appl. No.: 18/102,383

(22) Filed: Jan. 27, 2023

(51) Int. Cl.

| | |
|---|---|
| ***B63B 39/06*** | (2006.01) |
| ***B63B 29/04*** | (2006.01) |
| ***B63B 79/10*** | (2020.01) |
| ***B63B 79/40*** | (2020.01) |

(52) U.S. Cl.
CPC ..... *B63B 39/06* (2013.01); *B63B 29/04* (2013.01); *B63B 79/10* (2020.01); *B63B 79/40* (2020.01); *B63B 2029/043* (2013.01)

(58) Field of Classification Search
CPC ..... B63B 39/06; B63B 29/04; B63B 79/10; B63B 79/40; B63B 2029/043
USPC ..... 701/21
See application file for complete search history.

(56) References Cited

U.S. PATENT DOCUMENTS

| | | | | |
|---|---|---|---|---|
| 6,138,601 | A | 10/2000 | Anderson et al. | |
| 7,188,581 | B1 | 3/2007 | Davis et al. | |
| 7,311,058 | B1 * | 12/2007 | Brooks | B63B 79/10 114/285 |
| 7,924,164 | B1 | 4/2011 | Staerzl | |
| 8,113,892 | B1 | 2/2012 | Gable et al. | |
| 9,278,740 | B1 | 3/2016 | Andrasko et al. | |
| 9,731,798 | B2 | 8/2017 | Heyring et al. | |
| 10,137,971 | B2 | 11/2018 | Andrasko et al. | |
| 10,259,555 | B2 | 4/2019 | Ward et al. | |
| 10,372,976 | B2 | 8/2019 | Kollman et al. | |
| 10,429,845 | B2 | 10/2019 | Arbuckle et al. | |
| 2016/0142877 | A1 * | 5/2016 | Gujral | E05F 15/77 455/456.1 |
| 2019/0118907 | A1 * | 4/2019 | Larson | B63B 39/061 |
| 2020/0160726 | A1 | 5/2020 | Malouf et al. | |
| 2020/0202719 | A1 | 6/2020 | Derginer et al. | |
| 2021/0053657 | A1 * | 2/2021 | Hartman | B63B 34/70 |
| 2021/0179117 | A1 * | 6/2021 | Glazman | B60H 1/00357 |

FOREIGN PATENT DOCUMENTS

| | | |
|---|---|---|
| WO | 2021149066 | 7/2021 |

* cited by examiner

*Primary Examiner* — Tyler D Paige
(74) *Attorney, Agent, or Firm* — Andrus Intellectual Property Law, LLP

(57) ABSTRACT

A method for controlling a marine vessel having two or more seats. The method includes determining which of the seats are occupied seats and adjusting a control setting for controlling the marine vessel based on which of the seats are the occupied seats to provide an adjusted control setting. The method further provides for controlling the marine vessel based on the adjusted control setting so as to reduce an effect of which of the plurality of seats are the occupied seats on at least one of a pitch and a roll of the marine vessel when underway.

20 Claims, 9 Drawing Sheets

SYSTEMS AND METHODS FOR CONTROLLING MARINE VESSELS BASED ON SEAT OCCUPANCY

FIELD

The present disclosure generally relates to systems and methods for controlling marine vessels, and particularly for controlling marine vessels based on seat occupancy.

BACKGROUND

The following U.S. Patents and published Patent Applications provide background information and are incorporated by reference in entirety.

U.S. Pat. No. 6,138,601 discloses a planing boat hull with right and left steps positioned so as to optimize the boat's trim angle at top speed. Right and left trim tabs are pivotably controlled. This provides an active hull to control boat trim angle and effectively reduce deadrise angle while maintaining a running surface trailing edge substantially free of discontinuities in the vertical direction.

U.S. Pat. No. 7,188,581 discloses a marine drive, a marine vessel, and drive combination have a trim tab with a forward end pivotally mounted to a marine propulsion device.

U.S. Pat. No. 8,113,892 discloses a marine propulsion control system that receives manually input signals from a steering wheel or trim switches and provides the signals to control actuators. The actuators can be hydraulic steering actuators or trim plate actuators. The arrangements allow the various positions of the actuated components to vary from one device to the other.

U.S. Pat. No. 9,278,740 discloses a system for controlling an attitude of a marine vessel having first and second trim tabs, which includes a controller having vessel roll and pitch control sections. The pitch control section compares an actual vessel pitch angle to a predetermined desired vessel pitch angle and outputs a deployment setpoint that is calculated to achieve the desired pitch angle. The roll control section compares an actual vessel roll angle to a predetermined desired vessel roll angle, and outputs a desired differential between the first and second deployments that is calculated to maintain the vessel at the desired vessel roll angle. When the controller determines that the magnitude of a requested vessel turn is greater than a first predetermined threshold, the controller decreases the desired differential between the first and second deployments, and accounts for the decreased desired differential deployment in its calculation of the first and second deployments.

U.S. Pat. No. 10,372,976 discloses an object detection system for a marine vessel having at least one marine drive including at least one image sensor positioned on the marine vessel and configured to capture an image of a marine environment on or around the marine vessel, and a processor. The object detection system further includes an image scanning module executable on the processor that receives the image as input. The image scanning module includes an artificial neural network trained to detect patterns within the image of the marine environment associated with one or more predefined objects, and to output detection information regarding a presence or absence of the one or more predefined objects within the image of the marine environment.

U.S. Pat. Nos. 7,924,164, 10,259,555, and 10,429,845, and U.S. Patent Application Publication Nos. 2020/0160726, and. 2020/0202719, each generally relate to object detection and sensing and are also incorporated by reference herein.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of a method for controlling a marine vessel having two or more seats includes determining which of the seats are occupied seats and adjusting a control setting for controlling the marine vessel based on which of the seats are the occupied seats to provide an adjusted control setting. The method further provides for controlling the marine vessel based on the adjusted control setting so as to reduce an effect of which of the plurality of seats are the occupied seats on at least one of a pitch and a roll of the marine vessel when underway.

Another aspect according to the present disclosure generally relates a system for controlling a marine vessel having two or more seats for carrying passengers. Weight sensors are operatively coupled to the two or more seats to provide weight measurements based on weights supported thereon, respectively. A control system is operatively coupled to the weight sensors to receive the weight measurements. The control system is configured to determine a center of mass for the two or more seats within the marine vessel based on the weight measurements received from the weight sensors and to compare the center of mass to a predetermined point within the marine vessel to determine an offset therebetween. The control system is further configured to adjust a control setting for controlling the marine vessel based on the offset determined for the center of mass to provide an adjusted control setting and to control the marine vessel based on the adjusted control setting so as to reduce an effect of the offset on at least one of a pitch and a roll of the marine vessel when underway.

In another aspect according to the present disclosure, the control system determines which of the two or more seats are occupied based on imaging data collected for the two or more seats via image sensors. The control system is configured to receive the imaging data from the one or more image sensors and analyze the imaging data to identify objects on the two or more seats. Determining which of the two or more seats are occupied seats is based on the objects identified thereon.

BRIEF DESCRIPTION OF THE DRAWINGS

The present disclosure is described with reference to the following drawings.

DETAILED DISCLOSURE

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Figure 1:
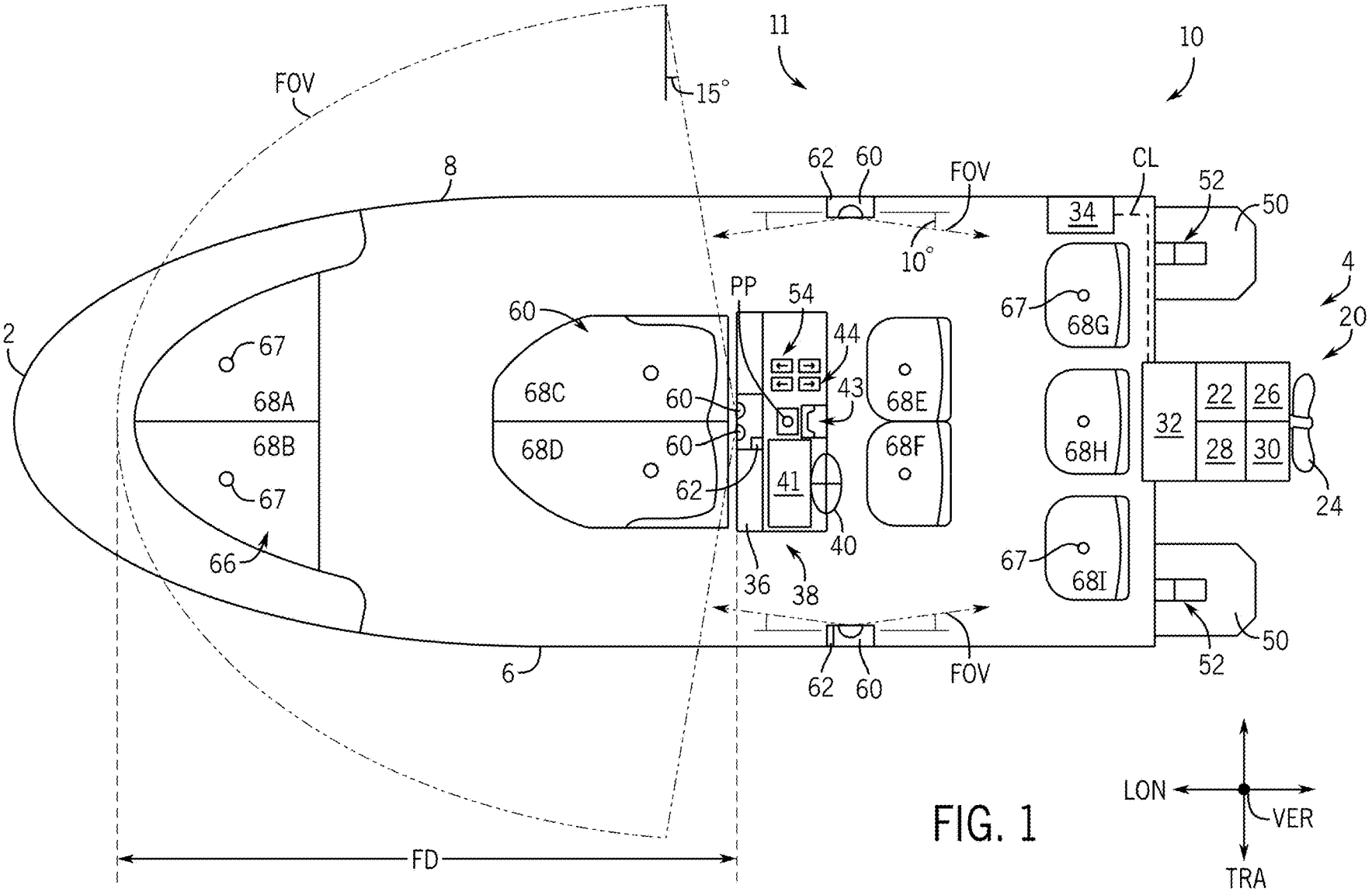
FIG. 1 is a top view of a marine vessel incorporating one embodiment of system according to the present disclosure for controlling a marine vessel.

FIG. 1 shows a system 10 according to the present disclosure for controlling a marine vessel 1 based weight distribution, which in certain cases varies based on seat occupancy. The marine vessel 1 extends between a bow 2 and a stern 4 along a longitudinal axis LON, and between a port side 6 and a starboard side 8 along a transverse axis TRA perpendicular to the longitudinal direction LON (each also being perpendicular to the vertical axis VER). The marine vessel 1 is propelled through the water by at least one marine drive 20, which while shown as an outboard motor could instead be an inboard motor, a stern drive, a pod drive, a jet drive, and/or the like. The marine drive 20 includes a powerhead 22. The powerhead 22 may be internal combustion engines (e.g., gasoline or diesel engines), one or more electric motors, a hybrid thereof, and/or the like. Each marine drive 20 includes a propeller 24 coupled in torque-transmitting relationship with a respective powerhead 22 so as to generate propulsion in the water.

The marine drive 20 further includes a powerhead speed sensor 26 measuring a speed of the powerhead 22 (or an output shaft thereof). The powerhead speed sensor 26 may be a shaft rotational speed sensor (e.g., Hall-Effect sensors) that measures a speed of the powerhead 22 in rotations per minute (RPM) in a manner known in the art. The marine drive 20 is further provided with a steering actuator 28 configured to steer the marine drive 20 in accordance with commands from a steering device as discussed further below. The steering actuator 28 may operate as a "steer by wire" system rather than including physical linkages between the marine drive 20 and steering input devices (e.g., a steering wheel). The steering actuator 28 includes a steering angle sensor therein, which provides feedback regarding the steering angle of the marine drive 20 in a manner known in the art. The steering actuator 28 may be hydraulically, pneumatically, and/or electromechanically operated. Additional information regarding exemplary steering actuators is provided in U.S. Pat. Nos. 7,150,664; 7,255,616; and 7,467,595, which are incorporated by reference herein.

Similarly, the marine drive 20 is provided with a trim actuator 30 configured to adjust the trim angle of marine drive 20 in a manner known in the art. The trim actuator 30 includes a trim angle sensor that provides feedback regarding the trim angle of the marine drive 20 in a manner known in the art. The trim actuator 30 may be hydraulically, pneumatically, and/or electromechanically operated. Additional information regarding exemplary trim actuators is provided in U.S. Pat. Nos. 6,583,728; 7,156,709; 7,416,456; and 9,359,057, which are incorporated by reference herein.

Each marine drive 20 also includes a propulsion control module (PCM) 32 that receives signals for operating the marine drive 20 in a manner known in the art, including the powerhead 22, the steering actuator 28, and the trim actuators 28. The propulsion control modules 32 each communicate with a central control module 34 (CCM 34), with the central control module 34 also communicating with a helm control module 36 (HCM 36) at a helm 38 of the marine vessel 1 in a conventional manner. Additional information regarding these elements, which together form a control system 100, is provided below.

The helm 38 includes a number of operator input devices through which an operator can input commands for controlling the marine vessel 1. These commands are received by the HCM 36 and communicated to the CCM 34 for controlling the PCMs 32 in the marine drive 20. The helm 38 of FIG. 1 includes a steering device, such as a steering wheel 40, which inputs steering commands for operating the steering actuator 28 to steer the marine vessel 1 in a manner known in the art. A throttle lever 43 is operable for providing thrust commands for the powerheads 22, including both a magnitude and a direction of thrust. The helm 38 further includes trim controls 44 (e.g., rocker switches or touchscreen controls) for adjusting the trim angles of the drive 20 via the trim actuators 28 in a manner known in the art.

The marine vessel 1 of FIG. 1 is further provided with conventionally known trim tabs 50 that are operable to adjust the pitch and/or roll of the marine vessel 1 when underway. The trim tabs 50 extend longitudinally rearwardly from the stern 4 and are adjustable via trim tab actuators 52, which may be electric, pneumatic, and/or hydraulically actuated in a manner known in the art. Additional information regarding trim tabs presently known in the art is provided in the background patents incorporated by reference above. Control of the trim tab actuators 52 is provided via trim tab controls 54 at the helm 38 (e.g., rocker switches or touchscreen controls), which allow the operator to adjust the positions of the trim tabs 50 together or independently. Control of the trim tab actuators 52 may also be controlled automatically in accordance with pre-set control settings, for example optimizing take-off when first accelerating, to provide a level marine vessel 1 while turning, and other control techniques known in the art. The trim tabs 50 may be controlled through a trim control module 51 within the control system 100 (see FIG. 2, discussed below). It should be recognized that inputs for controlling operations of the marine vessel 1 described herein, including the trim tabs 50, may be provided via other devices and techniques, including a multi-functional display 41 at the helm 38. Additionally, control settings for controlling the pitch and/or roll of the marine vessel 1 are not limited to controlling the trim tabs 50, but may also or alternatively include control of the trim angle, steering angle, or operation of the powerhead 22 for one or more of the marine drives 20.

The marine vessel 1 further includes a global positioning system (GPS) 56 that provides location and speed of the marine vessel 1 to the central control module 34. Additionally, or alternatively, a vessel speed sensor such as a Pitot tube or a paddle wheel could be provided to detect the speed of the marine vessel 1. The marine vessel 1 may also include an inertial measurement unit (IMU) or an attitude and heading reference system (AHRS) (collectively shown as the IMU/AHRS 58). An IMU has a solid state, rate gyro electronic compass that indicates the vessel heading and solid-state accelerometers and angular rate sensors that sense the vessel's attitude and rate of turn. An AHRS provides 3D orientation of the marine vessel 1 by integrating gyroscopic measurements, accelerometer data, and magnetometer data. The IMU/AHRS 58 could be GPS-enabled in place of a separate GPS 56.

With continued reference to FIG. 1, the marine vessel 1 further includes seats 66 configured to be occupied by passengers when the marine vessel is underway. The seats 66 are also labeled individual as seats 68A-68I. However, it should be recognized that the number of seats and locations of seats may vary. Moreover, while the present disclosure generally refers to these seats 66 as places for passengers to sit, the term "seat" more broadly includes any position in which a passenger or other object may be positioned during use of the marine vessel 1. By way of example, this includes positions within the marine vessel 1 meant for standing, laying down, or reclining. For simplicity, people or passengers are also referred to more generally as objects positioned on seats.

Weight sensors 67 are provided with each of the seats 66. The weight sensors 67 are configured to provide a weight measurement of a weight supported on the seat 66. The weight sensor 67 may be of a type presently known in the art, such as a piezo-electric sensor, weight-sensitive fabrics, and/or other load sensing technologies. The weight sensors 67 each communicate with the control system 100 (FIG. 2) discussed below. The weight sensors 67 are configured to provide weight measurements for the load supported on each seat 66, which as discussed below can be used to determine whether a particular seat 66 is occupied (e.g., by comparison to a minimum threshold), and/or the magnitude of the load supported thereon.

The system 10 further includes an object detection system 11 having one or more image sensors 60 and an image processor 62 that communicate within the control system 100 (FIG. 2) discussed below. The image sensors 60 capture images, or collect imaging data more generally, relating to objects within the marine vessel 1. The images sensors 60 may vary in type, field of view, focal distance, or mounting location on the marine vessel 1. Examples of image sensors 60 include proximity and/or vision-based sensors such as radars, sonars, LiDAR devices, cameras and/or stereo-vision cameras, lasers, and/or Doppler direction finders. It should be recognized that stereo-vision is not limited to any particular type of image sensors or packaging thereof. By way of example, one device may include two or more image sensors 60 specifically configured to provide stereo vision in a single housing or package. Alternatively, stereovision can be provided via processing data collected from the image sensors 60 of two more devices that are spaced apart from each other (each device having at least one image sensors 60, including having multiple image sensors 60 to themselves be configured to provide stereovision). Infrared light may also be used, such as to increase the ability to collect imaging data at night or under poor lighting conditions.

One example of an image sensor available in the market is the S27 Camera produced by Carnegie Robotics. Other suitable image sensors available in the market are produced by Avikus, Brightway, Sea Machines, and Buffalo Automation.

Separate image sensors 60 may be provided throughout the marine vessel 1 to ensure that all seats 66 are imaged by at least one image sensor 60. Similarly, image sensors 60 may be positioned on the marine vessel 1 so as to have overlapping fields of view. In an overlapping configuration, data from multiple image sensors 60 may be processed together to provide redundancy, provide views of a same object from different angles, for calibrating devices, image stitching, and/or to improve the accuracy of calculating distances (e.g., through triangulation techniques known in the art for processing images from two or more cameras). Overlapping fields of views may also be used to ensure that all areas of interest within the marine vessel 1 are covered, and/or to accommodate for any visual barriers inside the marine vessel. The present inventor has recognized that in marine vessels that already have images sensors for other purposes (e.g., for save navigation) can use these image sensors to provide the new functionality described herein.

In the system 10 of FIG. 1, one image sensor 60 is provided near the helm 38 facing longitudinally towards the bow 2 with two additional image sensors 60 at the port side 6 and starboard side 8 facing transversely inwardly. By way of example, the image sensor 60 facing the bow 2 may be configured to have a field of view FOV and a focal distance FD (e.g., 150-degrees, and between 0 and 10 meters, respectively, not shown to scale) so as to at least image the seats 66 forward of the helm 38, here seats 68A-68D. The images sensors 60 facing the port side 6 and the starboard side 8 are each shown having a 160-degree field of view FOV and a focal distance FD of 0 to 5 meters (not shown) so as to collectively image at least seats 68E-68I. Different sensors may be used to cover the different distances or to provide functionality in different lighting conditions (e.g., IR being more useful in low-lighting conditions). Likewise, different configurations of like sensors may be used, such as a camera with a wide FOV for near field vision and a camera with a standard FOV for longer distances (i.e., wide FOV cameras tending to have poor resolution at greater distances).

In addition to every seat 66 being within the field of view FOV and focal distance FD of an image sensor 60, the arrangement of FIG. 1 provides for overlapping and redundancy. For example, a person seated in seat 68F may block the view of seat 68E for the image sensor 60 on the port side 6. However, in this case, the image sensor 60 on the starboard side 8 would still have an unobstructed view of seat 68E. Imaging of a same object by multiple image sensors 60 also gives the system 10 views from different angles, which may help determine the presence and identity of an object, as discussed further below.

Figure 2:
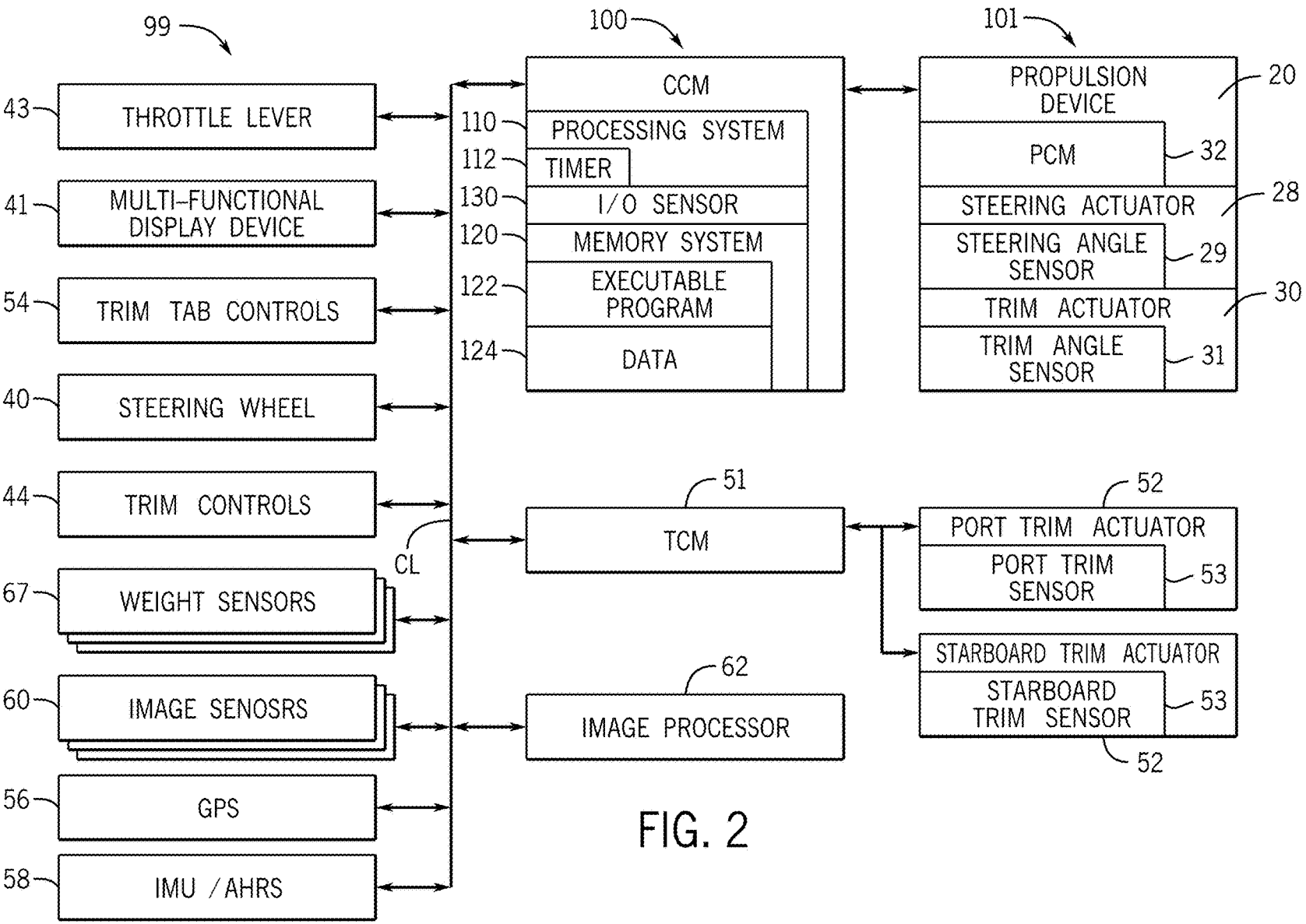
FIG. 2 is schematic view of a control system such as may be incorporated within the marine vessel of FIG. 1.

Additional information is now provided for the control system 100 of FIG. 2, which as discussed above may be used within the system 10 of FIG. 1. The control system 100 includes one or more central control modules 34, one or more propulsion control modules 32, the helm control module 36, one or more image processors 62, and/or other controllers. A person of ordinary skill in the art will recognize that these subsystems may also be present within additional central control modules 34 (as applicable) and/or propulsion control modules 32 or other controllers within the marine vessel 1. In the example shown, the central control module 34 includes a processing system 110, which may be implemented as a single microprocessor or other circuitry or be distributed across multiple processing devices or sub-systems that cooperate to execute the executable program 122 from the memory system 120. Non-limiting examples of the processing system include general purpose central processing units, application specific processors, and logic devices.

Each central control module 34 further includes a memory system 120, which may comprise any storage media readable by the processing system 110 and capable of storing the executable program 122 and/or data 124. The memory system 120 may be implemented as a single storage device or be distributed across multiple storage devices or sub-systems that cooperate to store computer readable instructions, data structures, program modules, or other data. The memory system 120 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example. An input/output (I/O) system 130 provides communication between the control system 100 and peripheral devices, such as input devices 99 and output devices 101, which are discussed further below. In practice, the processing system 110 loads and executes an executable program 122 from the memory system 120, accesses data 124 stored within the memory system 120, and directs the system 10 to operate as described in further detail below.

A person of ordinary skill in the art will recognize that these subsystems within the control system 100 may be implemented in hardware and/or software that carries out a programmed set of instructions. As used herein, the term "central control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. As shown in FIG. 2, one or more central control modules 34 may together constitute a control system 100. The one or more central control modules 34 can be located anywhere on the marine vessel 1.

A person of ordinary skill in the art will understand in light of the disclosure that the control system 100 may include a differing set of one or more control modules, or control devices, which may include propulsion control modules (PCMs) or propulsion control modules 42 for each marine drive 20, one or more thrust vector control modules (TVMs), one or more helm control modules (HCMs), and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

With continued reference to FIG. 2, the control system 100 communicates with each of the one or more components of the marine vessel 1 via a communication link CL, which can be any wired or wireless link. The illustrated communication link CL connections between functional and logical block components are merely exemplary, which may be direct or indirect, and may follow alternate pathways. The control system 100 is capable of receiving information and/or controlling one or more operational characteristics of the marine vessel 1 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the marine vessel 1. Moreover, the communication link CL lines are meant only to demonstrate that the various control elements are capable of communicating with one another, and do not represent actual wiring connections between the various elements, nor do they represent the only paths of communication between the elements. Additionally, the marine vessel 1 may incorporate various types of communication devices and systems, and thus the illustrated communication links CL may in fact represent various different types of wireless and/or wired data communication systems.

As will be discussed further below, the control system 100 communicates with input devices 99 from various components such as the trim tab controls 54, image sensors 60, and/or weight sensors 67. The control system 100 also communicates with output devices 101 such as the trim actuators 52 (FIG. 1) that adjust the positions of the trim tabs 50, as well as the propulsion control module 42, steering actuator 28, and trim actuator 30 for the marine device 20. It will be recognized that the arrows shown in FIG. 2 are merely exemplary and that communication may flow in more than one direction and/or through different paths. By way of example, steering angle sensors 29 and trim angle sensors 31, while shown as corresponding to the steering actuators 28 and trim actuators 30, may serve as separate input devices 99 feeding into the one or more central command modules 34.

The present inventor has recognized challenges with respect to how marine vessels known in the art control the pitch and/or roll of the vessel when underway. In particular, these systems and methods can provide inadequate correction and/or be slow to respond to issues or changes with pitch and/or roll, to control the marine vessel to quickly get up on plane, and/or to maintain balance as the marine vessel turns or changes speed. Through experimentation and development, the present inventor has recognized that these deficiencies in performance and response time may be caused or exacerbated by the marine vessel being loaded in an unknown and/or unbalanced manner. The control settings for conventionally operating the marine vessel (including operation of the trim tabs) are based on an assumption that the center of mass is at a known, predetermined point in the marine vessel. Therefore, if the actual center of mass is offset from the predetermined position in the transverse direction TRA and/or the longitudinal direction LON, these same standard control settings now provide suboptimal results for the marine vessel.

As such, the present inventor has further recognized that the performance of the marine vessel may therefore be improved by adjusting the control settings for the marine vessel based on the particular loading of the marine vessel. This can be accomplished by determining which seats on the marine vessel are occupied, thereby providing insight as to the impacts that this loading has on the balance of the marine vessel. As discussed further below, seat occupancy can be determined through the use of weight sensors and/or using vision systems to determine the occupancy of the seats throughout the marine vessel.

With reference to FIGS. 1 and 2, a position of each seat 66 is stored in a memory system 120 within the control system 100. These positions may be relative to the predetermined position PP that is the position expected to be the center of mass of the marine vessel 1, or from another reference point. By knowing which seats 66 are occupied, along with the positions of those occupied seats 66 within the marine vessel 1, the system 10 can then determine of the impact of the occupied seats 66 on balance, as well as on the pitch and the roll of the marine vessel 1. The system 10 can then further accommodate or correct this impact by adjusting the control settings of the marine vessel 1, such as by adjusting the trim tabs 50 accordingly. In other words, the marine vessel 1 is then controlled based on the adjusted control settings, rather than on the standard control settings that do not recognize the loading within the marine vessel.

Figure 3:
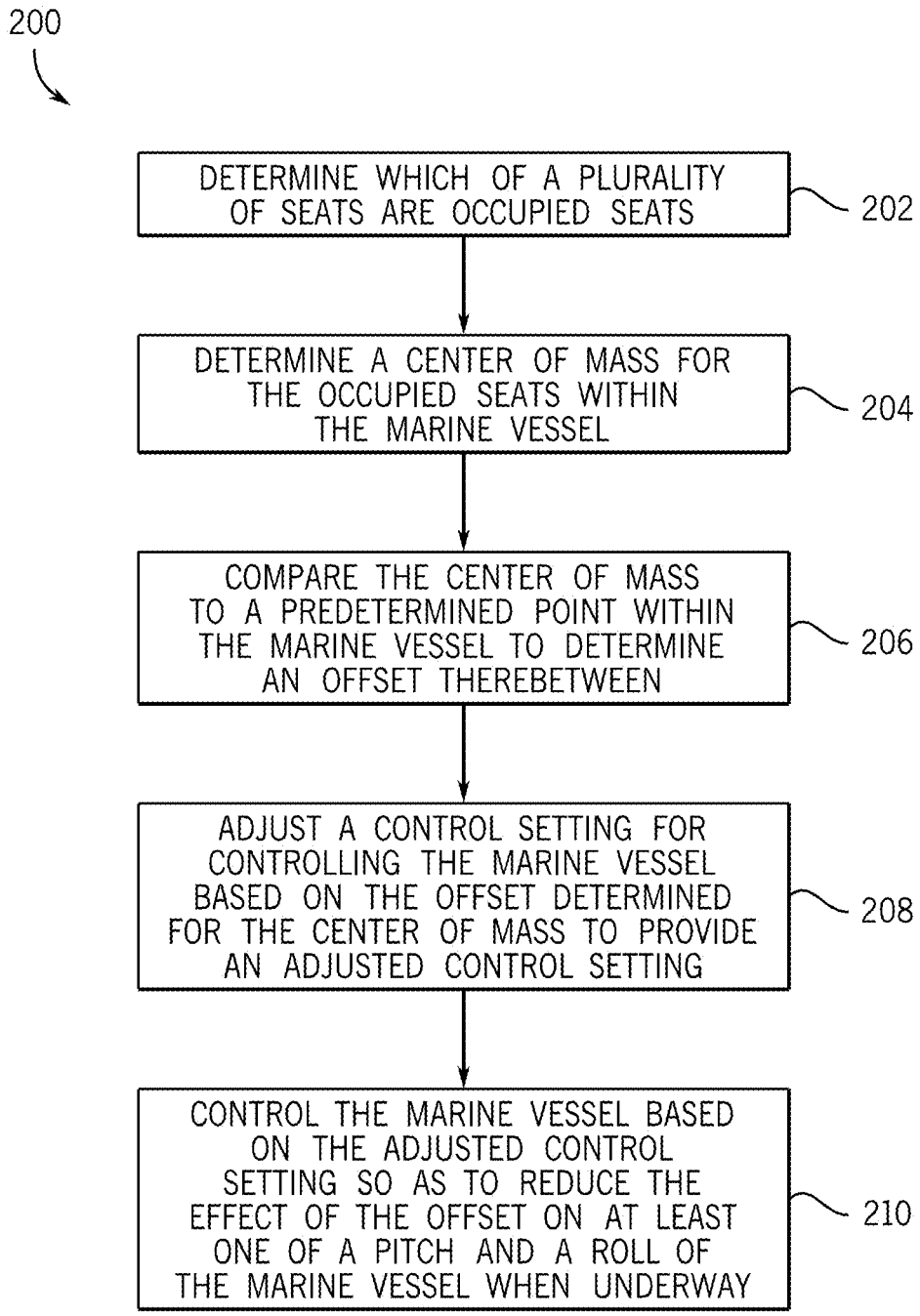
FIG. 3 depicts an example of one method according to the present disclosure for controlling a marine vessel.
Figure 4:
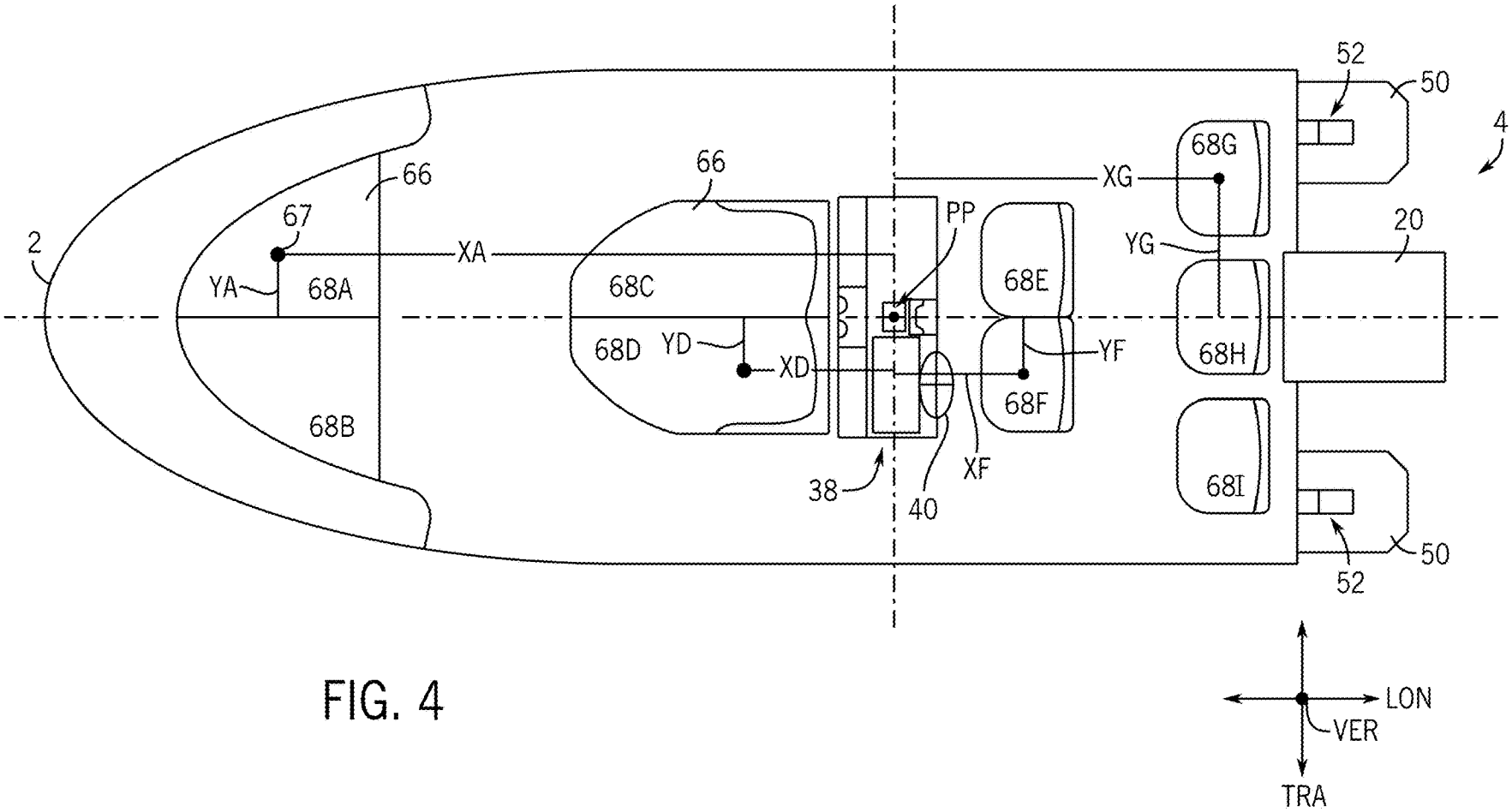
FIG. 4 is a top view of the marine vessel of FIG. 1 depicting how the method of FIG. 3 may be performed.

FIGS. 3 and 4 show one example of a method 200 for controlling a marine vessel 1 according to the present disclosure, and particularly based on the seat occupancy on the marine vessel 1. Step 202 provides for determining which of the seats 66 are occupied. This may be accomplished via weight sensors 67 associated with the seats 66, or using a vision system as discussed further below. In certain configurations, a seat 66 is determined to be occupied when the weight measurement from the weigh sensor 67 corresponding thereto exceeds a threshold value, such as 10 kg or 50 kg (approximately 30 or 120 lbs). In another configuration, any valid weight measurement (e.g., any measurement over zero or a nominally low value) is deemed to correspond to an occupied seat.

Step 204 provides for determining a center of mass for the occupied seats 66 using conventional methods for calculating a singular weight and position wherein the weighted relative position of distributed masses sums to zero (i.e., the balance point of the occupied seats). One conventional technique for determining the center of mass is via a static float to determine the position along the longitudinal and transverse axes, as well as a tilt test to verify the position along the vertical axis. This determination may use the actual weights measured for the occupied seats or may assume a given weight for each occupied seat irrespective of the actual weight measured for that seat. The center of mass for the occupied seats is then compared in step 206 to the predetermined point PP at which the marine vessel 1 assumes the center of mass to be. The output of step 206 is therefore an offset between the predetermined point PP and the center of mass determined for the occupied seats 66.

In certain configurations, as shown in FIG. 4, steps 204 and 206 can be combined or varied by determining the sum of the individual offsets between each occupied seat and the predetermined point PP, rather than first determining an overall center of mass for the occupied seats before comparing to the predetermined point PP. In the example of FIG. 4, seats 68A, 68D, 68F, and 68G are occupied seats, whereas the remaining seats 66 are unoccupied seats. The distances between each of the occupied seats and the predetermined point PP is determined in both the longitudinal direction LON and the transverse direction TRA, shown as (XA,YA), (XD,YD), (XF,YF), and (XG,YG), respectively. Distances closer to the starboard side 8 than the predetermined point PP are assigned a positive value in the transverse direction TRA (and vice versa), and distances closer to the stern 4 than the predetermined point PP are assigned a positive value in the longitudinal direction LON (and vice versa). In this manner, the longitudinal values for seat 68F and seat 68G are positive, whereas the longitudinal values for seat 68A and seat 68D are negative. By multiplying these distances with the weights measured for each correspondingly occupied seat (to the extent the same weight is not applied to all occupied seats), the offset can be determined for the center of mass of all occupied seats relative to the predetermined position PP.

With continued reference to FIGS. 3 and 4, this offset creates or exacerbates issues with the marine vessel 1 adequately controlling pitch and/or roll during operation, as it represents forces that deviate from the assumptions in the standard control settings. In view of this, step 208 provides for adjusting the original control settings used for controlling the marine vessel based on the offset determined in step 206, thereby resulting in an adjusted control setting that accommodates for the images of this offset. In step 210, the marine vessel 1 is controlled according to the adjusted control setting rather than the original control setting, which reduces the effects of the offset on at least one of the pitch and the roll of the marine vessel when underway.

By way of example, if the offset between the center of mass of the occupied seats 66 and the predetermined point PP provides that the marine vessel 1 is starboard heavy, the trim tab 50 on the starboard side 8 and/or on the port side 6 may be adjusted (via the corresponding trim actuator(s) 52) to restore balance. The same concept applies to being bow heavy or stern heavy, also recognizing that the offset need not be exclusively in the longitudinal direction LON or transverse direction TRA. The present disclosure also contemplates configurations in which offsets are calculated in the vertical direction.

In certain embodiments, the offset is calculated a linear function, such as providing 1% more trim tab angle for every 100 ft-lbs of offset. In other embodiments, the offset is calculated via models or algorithms that are non-linear and/or include other factors such as vessel speed, current trim tab angle, and/or steering angle.

In certain embodiments, the adjustments may be specific to a given hull form. For instance, a wake boat with a flat transom may be very sensitive to offset weight closer to the stern and not as sensitive closer to the bow. The adjustments may also or alternatively vary for take-off versus planning. In this case, the trim tabs may be controlled to provide more lift upon take-off if the vessel is determined to be bow heavy, then reduce the lift as the marine vessel approaches planing to prevent burying the bow.

Figure 5:
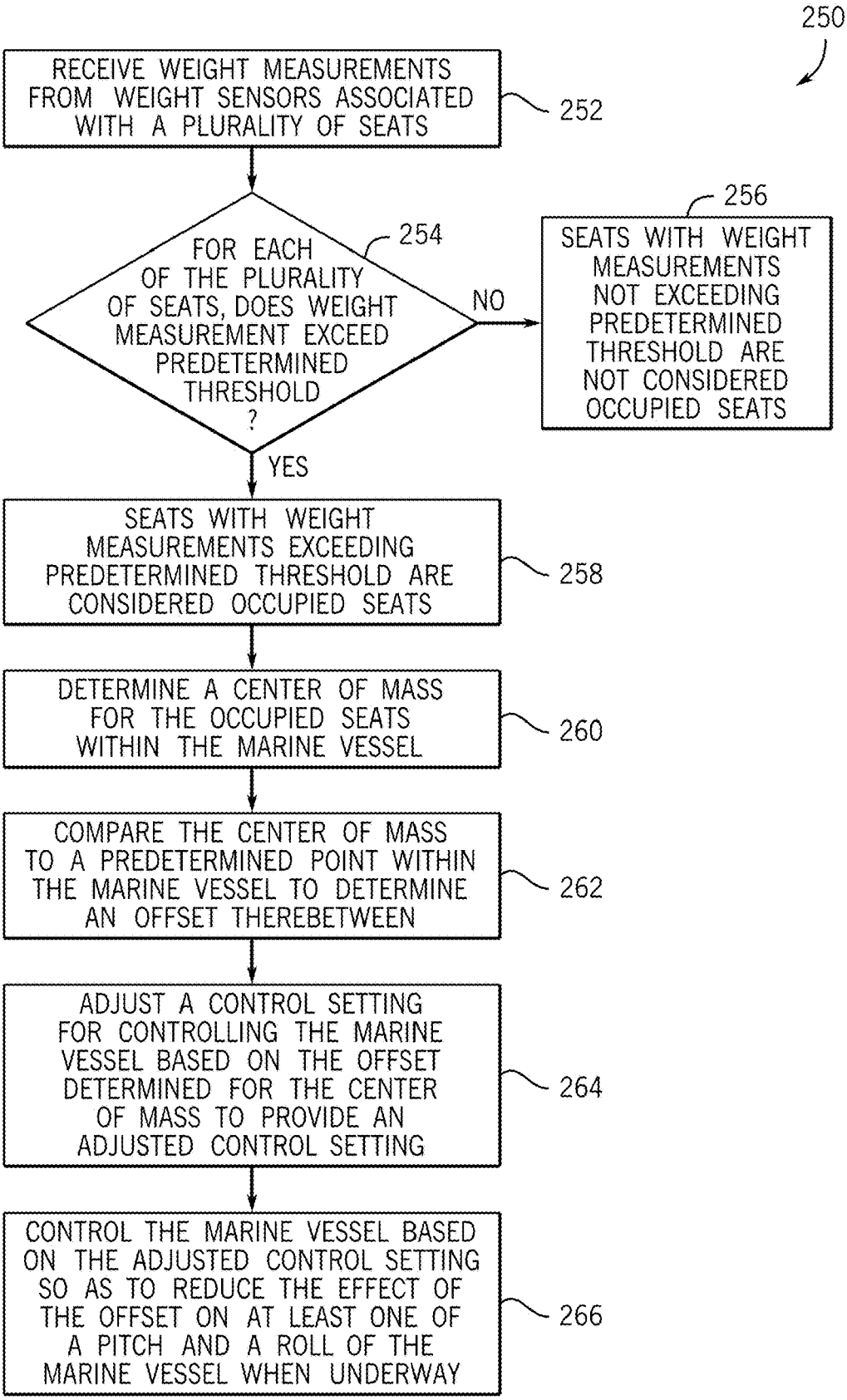
FIG. 5 depicts an example of another method according to the present disclosure for controlling a marine vessel.

FIG. 5 depicts another example of a method 250 according to the present disclosure, this time specifically detailing steps for a configuration using weight sensors 67 to determine seat occupancy. In this method 252, weight measurements from the weight sensors 67 are received and compared in step 254 to predetermined thresholds stored in memory. As discussed above, these predetermined thresholds may be set low enough to simply determine whether anything is on the seat 66 at all, whether the object on the seat 66 is heavy enough to consider (e.g., 10 kg or 50 kg), or whether the object on the seat 66 is a person, which may be further divided into a child or an adult (e.g., 15 kg and 50 kg, respectively). If the weight measurement comparison of step 254 does not meet or exceed the threshold, the corresponding seat 66 is determined to be unoccupied in step 256.

If instead the weight is found to meet or exceed the threshold in step 254, the corresponding seat 66 is determined to be an occupied seat 66 is step 258. From there, steps 260 through 266 may proceed in a similar manner as steps 204 through 210 as discussed above.

Referring back to FIG. 1, another mechanism for determining seat occupancy is using a vision system such as the object detection system 11 as discussed above. The object detection system is used to determine which of the seats 66 are occupied by a person (or object more generally), which can then be used in the same manner as the weight sensors 67 to determine an offset and correction for adjusting control settings for operating the marine vessel 1. In certain examples, the object detection system 11 not only determines whether a seat 66 is occupied, but also provides additional information for estimating the weight of each object positioned in each occupied seat 66. This allows for a more accurate determination of the offset caused by occupancy (i.e., versus assigning a single weight to each occupied seat), and likewise a more accurate adjustment for improved pitch and/or roll control.

Figure 6:
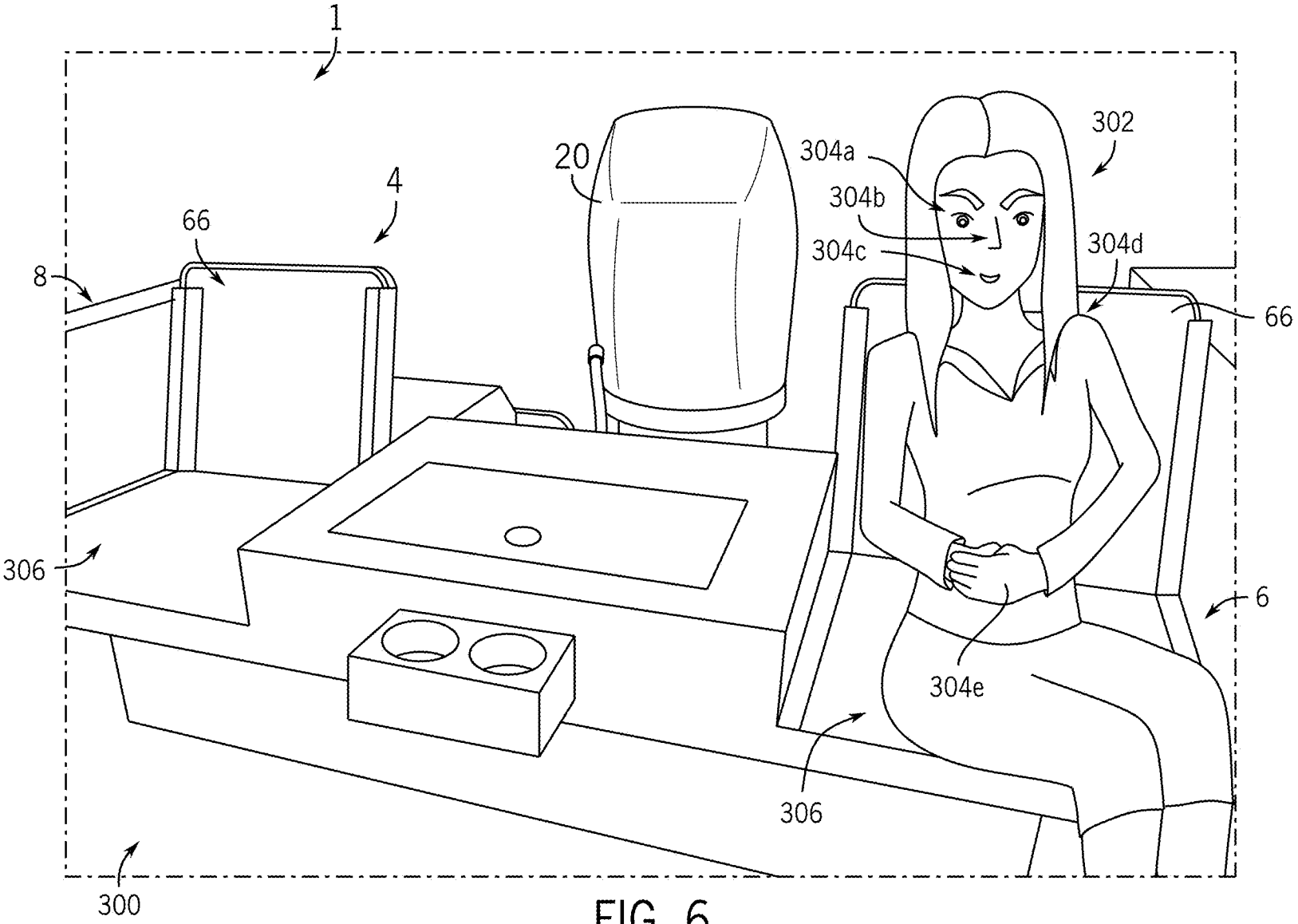
FIG. 6 depicts an example of one image collected from a system according to the present disclosure such as shown in FIG. 1.

As discussed above, the object detection system 11 includes one or more image sensors 60 and one or more the image processors 62, which may be considered part of the control system 100 more generally. With reference to FIG. 6, the object detection system may incorporate edge detection technology, computer vision machine learning (CVML), and/or an artificial neural network trained to detect patterns or predefined objects within the images 300 captured by the image sensors 60. A library of images preclassified as corresponding to particular objects (e.g., different types of seats 66, including typical upright and reclining seats, people, footwear, towels, gas cans, bags and purses, or water equipment such as skis, wakeboards, ropes, inflatables). It should be recognized that these objects may be identified though detection of sub-objects, such as individual facial or body features such as eyes 304*a*, noses 304*b*, mouths 304*c*, teeth, ears, hair, arms, shoulders 304*d*, elbow, hands 304*e*, legs, knees, feet, and/or the like being associated with a person as the object 302, or seat cushions 306 that are part of a seat 66.

A sequence of images may also be compared, or images compared over time, to assist in identifying an object. By way of example, a sequence of images may be compared knowing that a person can only move by a certain distance within a certain period of time (e.g., 1 meter per second), or that certain objects or sub-objects move in predictable and/or limited ways, such as the movement of a mouth, a person running hands through hair, or crossing legs.

The image processor 53 and/or control system 100 more generally may also determine the identity of an object 302 by determining its size (or sizes of components thereof). The size of an object can be determined by comparison to another object of known size, such as an object positioned in a seat next to a marine drive of known size. The distance between the image sensor 60 and the object can also be used to determine the size of the object, such as using stereovision techniques known in the art. These stereo-vision techniques can be performed using 2-dimensional data or images without the need for a sensor directly sensing the distances to the objects (e.g., time-of-flight sensors). In particular, stereovision uses images from image sensors 60 that are separated from each other by a distance. The images sensors 60 are used to capture imaging data of the same object, but from different perspectives. The imaging data from the two or more image sensors 60 are analyzed to identify features of that same object within the images, such as the crest of a wave as the object.

In view of this, the imaging data collected by the images sensors 60 can further be compared to determine the distance (or depth) to these features of the object via triangulation, a process also known as disparity mapping. Other methods and technologies may also or alternatively be used for identifying the distances to objects within the imaging data. By way of example, LIDAR or other Time-of-Flight technologies may be used to determine the 3-dimensional positions of the key points for calculating measurements.

The calculated distance to the object can then be referenced in conjunction with the number of pixels comprising the object within the imaging data, as well as and known characteristics of the image sensors 60 (e.g., field of view), to determine the true size of the object. This true size may be important in determining what the object is, whereby a given object may be required to have a size between an upper and/or lower threshold. By way of example, the system 10 may include stored size ranges for different types of objects, such as ranges of heights and widths for adult women sitting and standing, adult men sitting and standing, children sitting and standing, a folded towel, a cooler, a can of soda, and/or the like.

In addition, or in the alternative, the control system 100 may use "most important object" (MIO) techniques to identify the object of interest (e.g., an empty seat, an adult person, and a child person), as those discussed in U.S. Patent Application Publication No. 2020/0160726. In this manner, MIO techniques can help exclude analysis for objects of lesser interest, such as sunglasses, sunscreen containers, and other objects that while in the imaging data have little or no relevance on loading.

Figure 7:
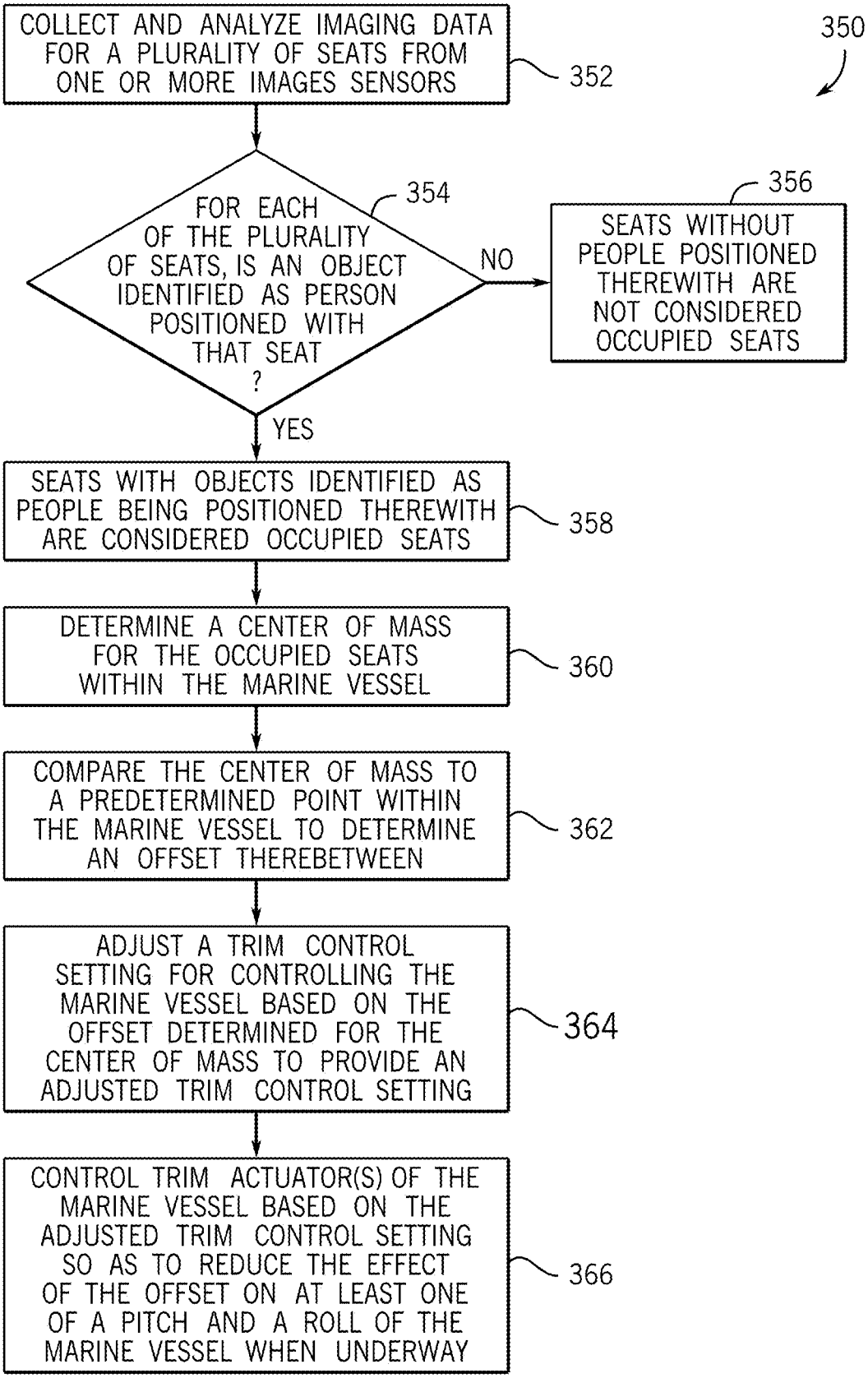
FIG. 7 depicts an example of a method according to the present disclosure for controlling a marine vessel, such as based on the image of FIG. 6.

FIG. 7 depicts an example of a method 350 according to the present disclosure. Step 352 provides for collecting and analyzing the imaging data collected for the seats in the marine vessel from one or more image sensors. Step 354 determines whether any of the seats has an object positioned thereon (or in close proximity thereto). For the image 300 of FIG. 6, the object detection system 11 is configured to recognize that the seat 66 on the starboard side 8 at the stern 4 is unoccupied. By way of example, an unoccupied seat can be determined by identifying that the entirety of a seat cushion 306 is visible, or that no other object 302 is within a particular threshold distance therefrom (e.g., 0.5 meters). In contrast, an object 302 is positioned in the seat 66 on the port side 6 at the stern 4. Step 356 provides that any seats determined to not have an object associated therewith are considered unoccupied seats. Alternatively, seats determined to have objects associated therewith are considered to be occupied seats in step 358. With continued reference to FIG. 7, steps 360 through 366 may then proceed in a similar manner as steps 204 through 210 from the method 200 of FIG. 3, as described above.

Figure 8:
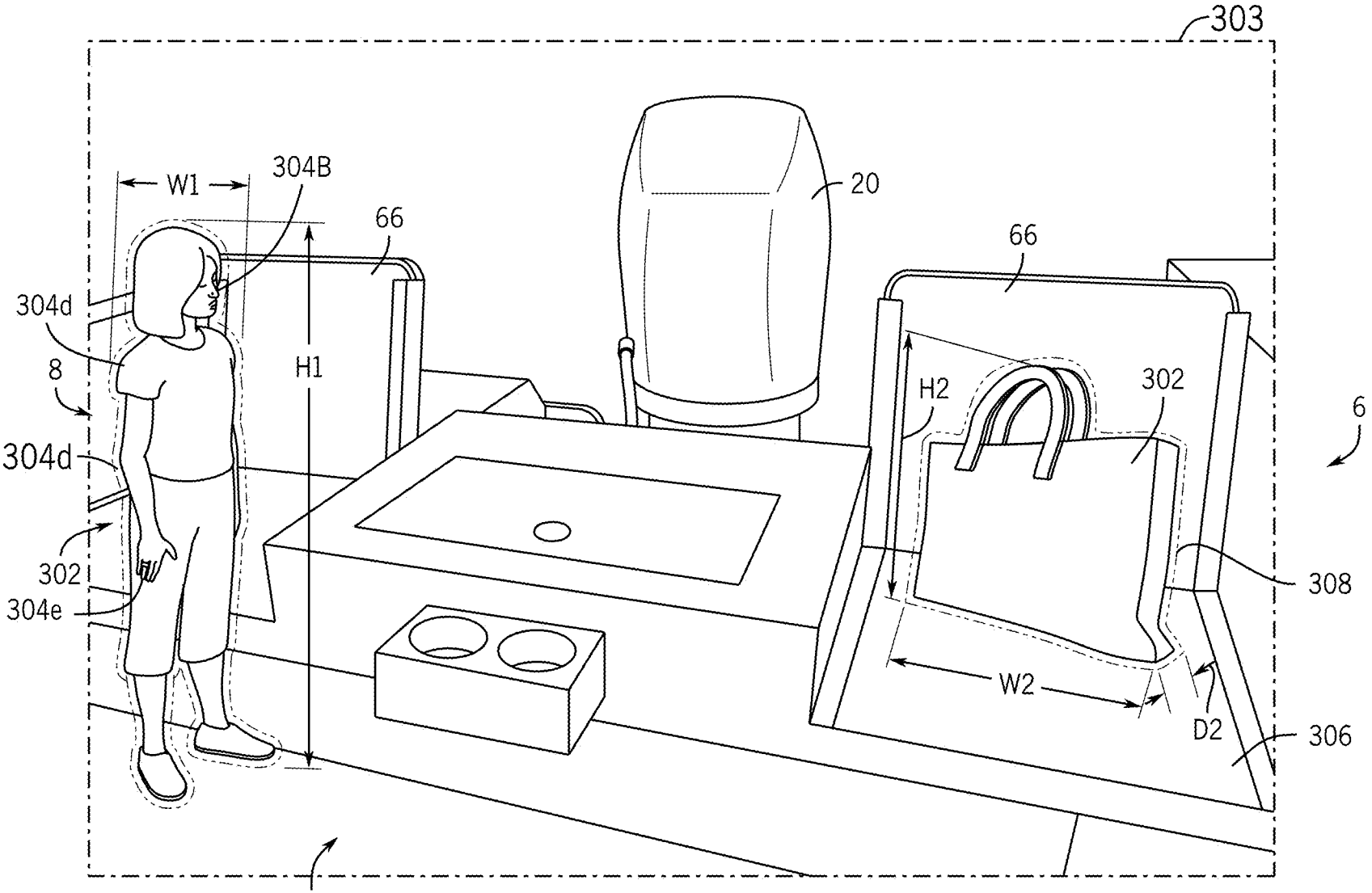
FIG. 8 depicts an example of another image collected from a system according to the present disclosure such as shown in FIG. 1.
Figure 9:
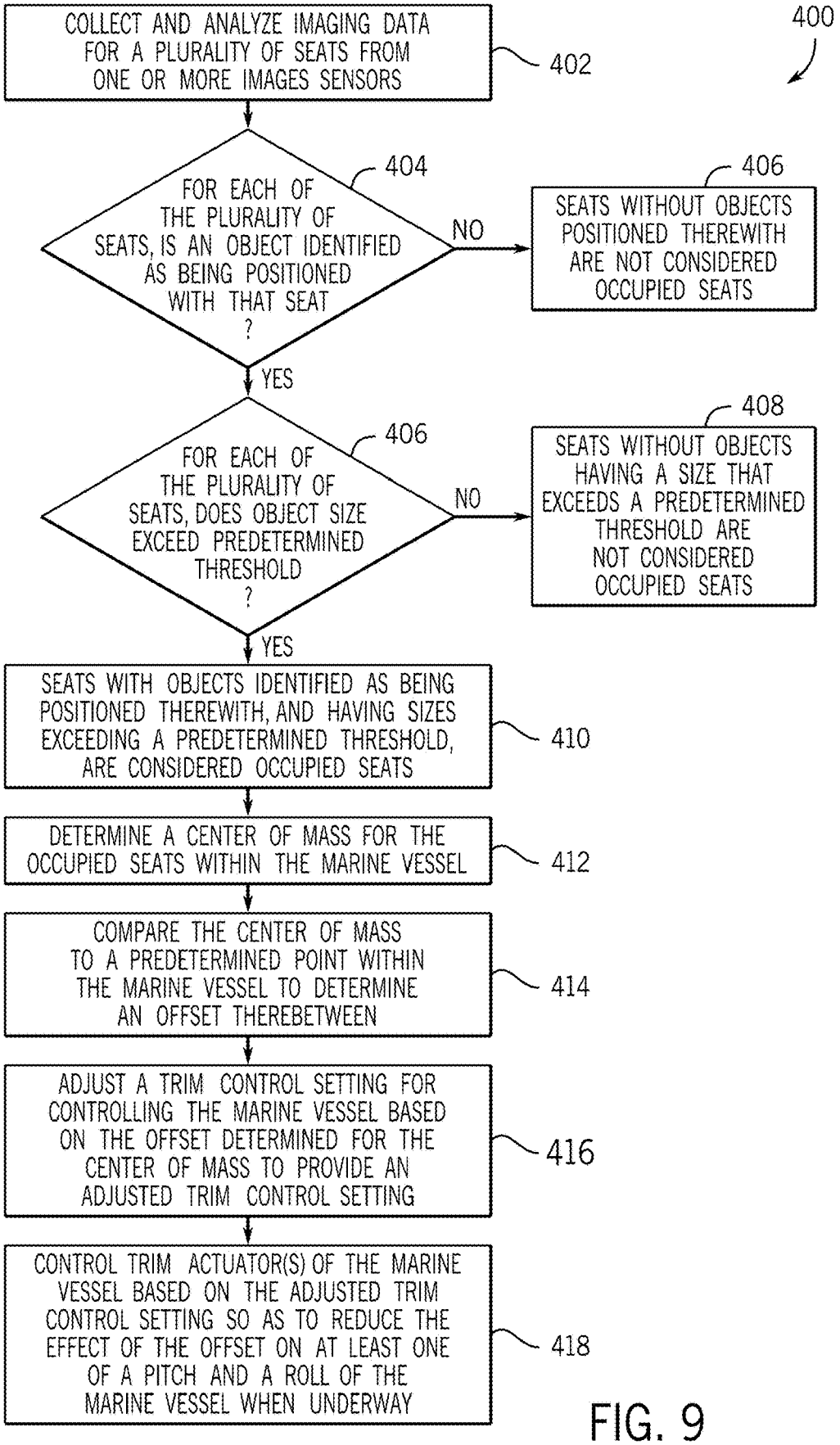
FIG. 9 depicts an example of a method according to the present disclosure for controlling a marine vessel, such as based on the image of FIG. 8.

FIGS. 8 and 9 depict another method 400 according to the present disclosure that again uses imaging data from image sensors, but also considers the sizes of objects in the control process. Steps 402 through 406 may proceed in a similar manner to steps 352 through 356 of the method 350 of FIG. 7 or steps 204 through 210 as discussed above for FIG. 3. In the method 400, each seat having an object positioned thereon is not necessary considered an occupied seat. Rather, step 408 provides for determining whether a given object 302 on a seat 66 exceeds a predetermined threshold. This may be akin to the weight measurement thresholds discussed above, whereby the system need not make adjustments for objects having an insignificant weight. Likewise, step 408 may provide as a confirmation of an identify of an object identified in step 404, such as placing limitations on sizes that may correspond to a human (e.g., having a height between 0.3 and 1.3 meters above a seat cushion 306 and/or between 0.5 and 2.3 meters about a floor 307 of the marine vessel 1. Similar measurements and limitations may also be provided for the widths and depths of objects 302 identified within the image 303. The determinations of height, width, and depth of an object may consider the angle in which the object 302 is positioned relative to the image sensor, such as by identifying shoulders 304*d*, distances between the image sensor and each shoulder 304*d* (e.g., via stereo-vision techniques known in the art), and calculating the width as the true width between the shoulders 304*d* rather than the width as it appears in the image 303. It should be recognized that other features and/or techniques may be used to determine the true dimensions of the objects 302.

By determining the actual height, width, and depth of the objects 302, the objects 302 can be more accurately compared to various thresholds such as those provided above. However, the present disclosure also contemplates methods in which such corrections are not made. The approximation of the width as it appears in the image 303 may be sufficiently accurate for the purposes for adjusting the control of the marine vessel.

In the image 303 of FIG. 8, the object 302 standing in front of the seat 66 nearest the starboard side 8 and stern 4 has a height H1 of 1.1 meters and a width W1 of 0.4 meters. Comparing this information to tables and other data stored in memory, the system 10 may conclude that this object is sufficiently large to consider the seat 66 to be occupied (i.e., meeting any predetermined thresholds on size). Edge detection or other techniques known in the art may also be used to identify the edge 308 of the object 302, which here when compared to models will be found to correspond to the outline or border of specifically a person. Thus, the system 10 may conclude that this object 302 is a child or small adult.

In contrast, the object 302 nearest the port side 6 at the stern 4 has a height H2 of 0.5 meters and a width W2 of 0.5 meters. A depth D2 measurement is also shown, which here is only 0.1 meters. In this manner, the system 10 may determine that the object 302 is too small of a depth D2 to be a person and thus must be something else. Edge analysis may further identify that the edge 308 of this object 302 corresponds to a tote, briefcase, or bag. Depending on the thresholds saved in memory, which may vary based on the type of object (e.g., person versus non-person), the object 302 on the port side 6 may be considered an object sizeable enough to consider the seat 66 occupied (step 410), or small enough to not consider the seat 66 occupied (step 408).

Steps 412 through 418 may again be performed similarly to steps 204 through 210 as discussed above for FIG. 3. However, as with the methods relative to weight measurements, different values may be used for weights at each occupied seat depending on the size of the object. For example, if an object 302 is determined to be a child, the seat 66 associated therewith may be assumed to carry a 25 kg load, whereas an adult may be assumed to weight 80 kg. It should be recognized that the weight assumptions may be simple or complicated depending on the complexity of data stored in memory. By way of example, an object identified as a human may be assigned significantly more weight than a similarly sized object identified to be a stack of towels.

In certain embodiments, the system 10 is configured to determine the center of mass for occupied seats on a periodic or ongoing basis. In this manner, people or objects moving around in the marine vessel may be accounted for in the adjustments to the control system for operating the marine vessel. This may be particularly advantageous for activities such as fishing or watersports in which people may initially be well distributed or even more heavily positioned towards the bow initially, but move towards the stern at a later point in time.

The systems and methods disclosed herein therefore allow the system to make adjustments as necessary when control settings for operating the marine vessel would be insufficient, or in general are not based on the present conditions of the marine vessel. The present inventor has recognized that this can improve the safety and performance of operating a marine vessel, as well as providing fuel efficiency for optimizing the operation of the marine vessel for the current conditions.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for controlling a marine vessel having a plurality of seats, the method comprising:

determining which of the plurality of seats are occupied seats;

adjusting a control setting for controlling the marine vessel with respect to pitch and/or roll thereof based on which of the plurality of seats are the occupied seats to provide an adjusted control setting; and controlling the marine vessel based on the adjusted control setting so as to reduce an effect of which of the plurality of seats are the occupied seats the pitch and/or roll of the marine vessel when underway.

2. The method according to claim 1, wherein the marine vessel comprises trim tabs that adjust at least one of the pitch and the roll of the marine vessel when underway, and wherein controlling the marine vessel comprises positioning the trim tabs based on the adjusted control settings.

3. The method according to claim 1, further comprising determining a center of mass for the occupied seats within the marine vessel and comparing the center of mass to a predetermined point to determine an offset therebetween, wherein adjusting the control setting for controlling the marine vessel is based on the offset determined for the center of mass, and wherein controlling the marine vessel based on the adjusted control setting reduces the effect of the offset on at least one of the pitch and the roll of the marine vessel when underway.

4. The method according to claim 3, wherein the marine vessel extends in a transverse direction between a port side and a starboard side with a centerline extending perpendicularly in a longitudinal direction therebetween, wherein the predetermined point is on the centerline, and wherein the center of mass is determined at least in part in the transverse direction.

5. The method according to claim 3, wherein the marine vessel extends in a transverse direction between a port side and a starboard side with a centerline extending perpendicularly in a longitudinal direction therebetween, further comprising providing known distances between the plurality of seats and the centerline in the transverse direction, and further comprising determining the center of mass based on the known distances in the transverse direction.

6. The method according to claim 3, wherein determining the center of mass comprises assuming a predetermined weight on each of the occupied seats.

7. A method for controlling a marine vessel having a plurality of seats, wherein each of the plurality of seats has a weight sensor configured to provide a weight measurement of a weight supported thereon, the method comprising:

determining which of the plurality of seats are occupied seats at least in part by receiving the weight measurement for each of the plurality of seats;

adjusting a control setting for controlling the marine vessel based on which of the plurality of seats are the occupied seats to provide an adjusted control setting; and controlling the marine vessel based on the adjusted control setting so as to reduce an effect of which of the plurality of seats are the occupied seats on at least one of a pitch and a roll of the marine vessel when underway.

8. The method according to claim 7, further comprising comparing the weight measurement for each of the plurality of seats to a predetermined threshold and determining which of the plurality of seats are the occupied seats based on whether the weight measurement corresponding thereto exceeds the predetermined threshold.

9. The method according to claim 7, further comprising determining a center of mass for the occupied seats within the marine vessel based on the weight measurement for each of the occupied seats, and further comprising comparing the center of mass to a predetermined point within the marine vessel to determine an offset therebetween, wherein adjusting the control setting for controlling the marine vessel is based on the offset determined for the center of mass, and wherein controlling the marine vessel based on the adjusted control setting reduces the effect of the offset on the marine vessel when underway.

10. A method for controlling a marine vessel having a plurality of seats, wherein the marine vessel further comprises one or more image sensors, the method comprising:

determining which of the plurality of seats are occupied seats at least in part by collecting imaging data of the plurality of seats from the one or more images sensors, analyzing the imaging data to identify objects on the plurality of seats, and determining which of the plurality of seats are the occupied seats based on the objects identified thereon;

adjusting a control setting for controlling the marine vessel based on which of the plurality of seats are the occupied seats to provide an adjusted control setting; and controlling the marine vessel based on the adjusted control setting so as to reduce an effect of which of the plurality of seats are the occupied seats on at least one of a pitch and a roll of the marine vessel when underway.

11. The method according to claim 10, wherein analyzing the imaging data further comprises determining sizes of the object and comparing the sizes to a predetermined threshold, wherein the occupied seats are determined based on which of the objects have sizes exceeding the predetermined threshold.

12. The method according to claim 10, wherein analyzing the imaging data further comprises determining which of the objects are passengers, wherein the occupied seats are determined based on which of the objects are determined to be the passengers.

13. A system for controlling a marine vessel having a plurality of seats for carrying passengers, the system comprising:

a plurality of weight sensors operatively coupled to the plurality of seats to provide weight measurements based on weights supported thereon, respectively; and a control system operatively coupled to the plurality of weight sensors to receive the weight measurements, wherein the control system is configured to:

determine a center of mass for the plurality of seats within the marine vessel based on the weight measurements received from the weight sensors;

compare the center of mass to a predetermined point within the marine vessel to determine an offset therebetween;

adjusting a control setting for controlling the marine vessel based on the offset determined for the center of mass to provide an adjusted control setting; and control the marine vessel based on the adjusted control setting so as to reduce an effect of the offset on at least one of a pitch and a roll of the marine vessel when underway.

14. The system according to claim 13, wherein the marine vessel extends between a bow and a stern in a longitudinal direction and between a port side and a starboard side in a transverse direction perpendicular to the longitudinal direction, and wherein the control system is configured to determine the offset between the center of mass and the predetermined point in both the longitudinal direction and the transverse direction.

15. The system according to claim 13, wherein the marine vessel comprises trim tabs that adjust at least one of the pitch and the roll of the marine vessel when underway, and wherein controlling the marine vessel comprises positioning the trim tabs based on the adjusted control settings.

16. A system for controlling a marine vessel having a plurality of seats, the system comprising:

one or more images sensors configured to collect imaging data of the plurality of seats; and a control system operatively coupled to the one or more image sensors, wherein the control system is configured to:

receive the imaging data from the one or more image sensors;

analyze the imaging data to identify objects on the plurality of seats;

determine which of the plurality of seats are occupied seats based on the objects identified thereon;

determine a center of mass for the occupied seats within the marine vessel;

compare the center of mass to a predetermined point within the marine vessel to determine an offset therebetween;

adjust a control setting for controlling the marine vessel based on the offset determined for the center of mass to provide an adjusted control setting; and control the marine vessel based on the adjusted control setting so as to reduce an effect of the offset on the marine vessel when underway.

17. The system according to claim 16, wherein the control system is further configured to analyze the imaging data to determine sizes of the objects and to compare the sizes to a predetermined threshold, wherein the control system is configured to determine which of the plurality of seats are the occupied seats based on which of the objects have sizes exceeding the predetermined threshold.

18. The system according to claim 17, wherein the control system is further configured to determine the center of mass based on the sizes of the objects on each of the occupied seats, respectively.

19. The system according to claim 16, wherein the control system is further configured to analyze the imaging data to determine which of the objects are passengers, and wherein the control system is configured to determine which of the plurality of seats are the occupied seats based on which of the objects are determined to be the passengers.

20. The system according to claim 19, wherein the control system is further configured to analyze the imaging data to determine whether any of the passengers are standing, and wherein the adjustment to the control setting is based on whether any of the passengers are determined to be standing.

* * * * *